US005916015A

United States Patent [19]

Natalicio

[11] Patent Number: 5,916,015

[45] Date of Patent: Jun. 29, 1999

[54] WAFER CARRIER FOR SEMICONDUCTOR WAFER POLISHING MACHINE

[75] Inventor: John Natalicio, Los Angeles, Calif.

[73] Assignee: SpeedFam Corporation, Chandler, Ariz.

[21] Appl. No.: 08/900,479

[22] Filed: Jul. 25, 1997

[51] Int. Cl.[6] ..... B24B 7/22

[52] U.S. Cl. ..... 451/288; 451/398; 451/388

[58] Field of Search ..... 451/288, 287, 451/289, 290, 285, 41, 398, 388

[56] References Cited

U.S. PATENT DOCUMENTS

| | | | |
|---|---|---|---|
| 4,918,869 | 4/1990 | Kitta . | |
| 4,918,870 | 4/1990 | Torbert et al. . | |
| 5,081,795 | 1/1992 | Tanaka et al. . | |
| 5,205,082 | 4/1993 | Shendon et al. . | |
| 5,377,451 | 1/1995 | Leoni et al. . | |
| 5,423,716 | 6/1995 | Strasbaugh | 451/287 |
| 5,441,444 | 8/1995 | Nakajima . | |
| 5,449,316 | 9/1995 | Strasbaugh . | |
| 5,527,209 | 6/1996 | Volodarsky et al. . | |
| 5,533,924 | 7/1996 | Stroupe et al. . | |
| 5,584,746 | 12/1996 | Tanaka et al. . | |
| 5,584,751 | 12/1996 | Kobayashi et al. | 451/398 |
| 5,624,299 | 4/1997 | Shendon | 451/288 |
| 5,643,061 | 7/1997 | Jackson et al. | 451/398 |
| 5,681,215 | 10/1997 | Sherwood et al. | 451/398 |
| 5,716,258 | 2/1998 | Metcalf . | |

FOREIGN PATENT DOCUMENTS

| | | |
|---|---|---|
| 0786310 | 7/1997 | European Pat. Off. . |

OTHER PUBLICATIONS

In Situ Monitoring Technique for Multi–Layer Interconnection, Fukuroda, et al, IEEE 1–1995.

*Primary Examiner*—Robert A. Rose
*Attorney, Agent, or Firm*—Snell & Wilmer, L.L.P.

[57] ABSTRACT

A carrier assembly for use in the processing of semiconductor wafers which avoids the use of a gimbal mechanism. The wafer carrier assembly comprises a backing pad for the wafer, with the wafer and backing pad secured within a retaining ring, such that the retaining ring, wafer, and backing pad move as single, integral assembly. A resiliently flexible outer housing terminates in a pad load ring transmits the rotation of the drive shaft to the load plate while allowing limited axial movement between the outer ring and inner ring assembly. The wafer/load plate assembly is permitted to float within the outer ring while the outer ring locally depresses the polishing pad near the wafer periphery, to mitigate edge exclusion.

23 Claims, 3 Drawing Sheets

WAFER CARRIER FOR SEMICONDUCTOR WAFER POLISHING MACHINE

TECHNICAL FIELD

The present invention relates, generally, to carrier assemblies for use in the processing of workpieces and, more particularly, to an improved semiconductor wafer carrier assembly for applying uniform pressure to a wafer during polishing without the use of a gimbal mechanism.

BACKGROUND ART AND TECHNICAL PROBLEMS

The increasing demand for integrated circuit devices has sparked a corresponding increase in demand for semiconductor wafers from which integrated circuit chips are made. The need for higher density integrated circuits, as well as the need for higher production throughput of integrated circuits on a per-wafer basis, has resulted in a need for increasing the flatness of the semiconductor wafer surface, both during initial production of the semiconductor wafer as well as during the actual building of the integrated circuit on the wafer surface.

The need for increased planarity of semiconductor wafer surfaces presents heretofore unencountered challenges for the chemical mechanical polishing (CMP) industry.

Presently known CMP machines typically employ either a single carrier or a plurality of carriers, each configured to hold a single semiconductor wafer firmly against a polishing surface, for example the upper surface of a rotating polishing pad. As a result of the relative motion between the semiconductor wafer surface to be polished and the polishing pad, coupled with the downward pressure applied by the wafer carrier to press the wafer against the polishing pad, even very small deviations in the uniformity of the pressure applied to the semiconductor wafer across the wafer surface can result in imperfections in the planarization process.

More particularly, many presently known wafer carrier assemblies employ a gimbal mechanism to permit the surface of the semiconductor wafer in contact with the polishing pad to remain parallel to the polishing pad, even if the polishing pad exhibits local deviations from planarity. Such gimballing mechanisms can be problematic, however, in that as the wafer "tilts" with respect to the vertical global axis of the carrier, uneven back pressure may be applied to the wafer resulting in compromised planarization. Moreover, many known gimbal mechanisms typically apply pressure to a backing plate which, in turn, applies pressure to the wafer. To the extent the gimbal mechanism applies point loading to the backing plate, relatively thick backing plates need to be employed to distribute the point loading more evenly across the back surface of the wafer. Increasing the thickness of the backing plate to ensure uniform loading, however, often places the gimbal point detrimentally high above the wafer polishing plane, which can sometimes cause the wafer to tilt with respect to the polishing surface, further compromising planarization of the finished workpiece.

For a fuller discussion of many presently known wafer carrier assemblies, see: Shendon et al., European Patent Application No. 96304118.1, filed May 6, 1996; Shendon et al., U.S. Pat. No. 5,205,082, entitled "Wafer Polisher Head Having Floating Retainer Ring", issued Apr. 27, 1993; Bolandi et al., U.S. Pat. No. 5,571,044, entitled "Wafer Holder for Semiconductor Wafer Polishing Machine", issued Nov. 5, 1996; Kobayashi et al., U.S. Pat. No. 5,584,751, entitled "Wafer Polishing Apparatus", issued Dec. 17, 1996; Nishio et al., European Patent Application No. 96105657.9, filed Oct. 4, 1996; Gill, Jr., U.S. Pat. No. 4,811,522, entitled "Counterbalanced Polishing Apparatus", issued Mar. 14, 1989; Stroupe et al., U.S. Pat. No. 5,533,924, entitled "Polishing Apparatus, A Polishing Wafer Carrier Apparatus, A Replaceable Component for a Particular Polishing Apparatus and A Process of Polishing Wafers", issued Jul. 9, 1996; Okumura et al., U.S. Pat. No. 5,398,459, entitled "Method and Apparatus for Polishing a Workpiece", issued Mar. 21, 1995; Chisholm et al., U.S. Pat. No. 5,522,965, entitled "Compact System and Method for Chemical-Mechanical Polishing Utilizing Energy Coupled to the Polishing Pad/Water Interface", issued Jun. 4, 1996; Shendon et al., U.S. Pat. No. 5,624,299, entitled "Chemical Mechanical Polishing Apparatus with Improved Carrier and Method of Use", issued Apr. 29, 1997; and Breivogel et al., U.S. Pat. No. 5,554,064, entitled "Orbital Motion Chemical-Mechanical Polishing Apparatus and Method of Fabrication", issued Sep. 10, 1996.

Presently known wafer carrier assemblies are unsatisfactory in several regards, resulting in compromised planarization of the finished semiconductor wafer or other workpiece. An improved semiconductor wafer carrier assembly is thus needed which overcomes the shortcomings of the prior art.

SUMMARY OF THE INVENTION

A semiconductor wafer carrier assembly is provided which overcomes many of the shortcomings associated with prior art devices.

In accordance with one aspect of the present invention, a wafer carrier assembly is provided which includes a backing pad positioned in intimate contact with all or substantially all of the backside (upward facing) surface of the semiconductor wafer, wherein air pressure may be applied to the backing plate to uniformly load the wafer against the polishing pad. In a preferred embodiment, the wafer and backing pad are secured within a retaining ring, such that the retaining ring, wafer and backing pad move as a single, integral assembly. In accordance with a further aspect of the present invention, the rotating carrier assembly is disposed at the distal end of a drive shaft, which terminates at a resiliently flexible outer housing; the outer housing terminates in a pad load ring which contains the aforementioned carrier/load plate/retaining ring assembly. As the outer pad load ring is rotationally driven by the drive shaft, the pad load ring transmits this rotation to the load plate through a series of drive tangs which simultaneously rotationally drive the load plate while allowing limited axial movement between the outer ring and the inner ring assembly. In this way, the wafer/load plate assembly is permitted to float within the outer ring, while the outer ring locally depresses the polishing pad in the immediate vicinity of the wafer edge to mitigate edge exclusion. Moreover, by driving the load plate peripherally, as opposed to axially, forces which might otherwise tend to tilt the wafer with respect to the polishing pad are essentially eliminated. In addition, by driving the rotation of the wafer peripherally, the axial region of the drive shaft may be used to facilitate a valve arrangement for porting high pressure, low pressure and vacuum to the wafer from a single source.

In accordance with a further aspect of the present invention, the use of a deformable outer housing as a means of connecting the drive shaft to the outer ring permits the outer ring to deflect axially with respect to the inner ring, while the outer ring exerts a substantially constant downward force on the backing pad as a result of a dead band incorporated into the axial position versus downward force characteristic of the outer housing.

In accordance with a further aspect of the present invention, the use of a peripheral drive mechanism in conjunction with a dual ring configuration permits the wafer assembly to float with respect to the outer ring without the need for a gimbal mechanism within the carrier assembly. This further reduces the incidents of forces which may tend to tilt the wafer.

In accordance with yet a further aspect of the present invention, by eliminating gimbal mechanisms from the carrier assembly, point sources of contact for applying pressure to the load plate are also eliminated. Consequently, the pressure air applied to the load plate for loading the wafer against the pad exhibits a high degree of uniformity, while employing a relatively thin load plate as opposed to prior art carrier assemblies employing gimbal mechanisms.

In accordance with yet a further aspect of the present invention, the floating outer ring configuration is configured to depress the pad in the vicinity of the wafer, even as the outer ring wears over time, mitigating edge exclusion effects.

In accordance with yet a further aspect of the present invention, a wafer loss sensing system is conveniently incorporated into the wafer carrier assembly. In a preferred embodiment, a plurality of (e.g., 3) wafer loss detection sensors are distributed within the carrier housing and configured to detect the presence of the wafer at a plurality of points across the back surface of the wafer. In accordance with a preferred embodiment, the wafer loss detection sensors comprise a capacitive sensing system, such that the wafer itself is part of the capacitive system. As long as the wafer remains intact, the global capacitance associated with each of the loss detection sensors remain substantially equal to one another. In the event the wafer should break or become cracked or otherwise dislodged from the carrier assembly, the value of capacitance detected at each of the loss detection sites would not be equal to one another, thus providing an early warning signal to the system operator that a wafer loss, wafer breakage or cracked condition in the wafer has occurred. Employing wafer loss detection sensors within the carrier housing is particularly advantageous in that it permits the operator to take appropriate action (e.g., cease operation of the machine) upon detection of a broken or dislodged wafer even before the wafer escapes from the carrier.

Various other advantages associated with the present invention are described more fully below in connection with the illustrated embodiments.

BRIEF DESCRIPTION OF THE DRAWING FIGURES

The subject invention will hereinafter be described in conjunction with the appended drawing figures, wherein like numerals designate like elements, and:

DETAILED DESCRIPTION OF PREFERRED EXEMPLARY EMBODIMENTS

Figure 1:
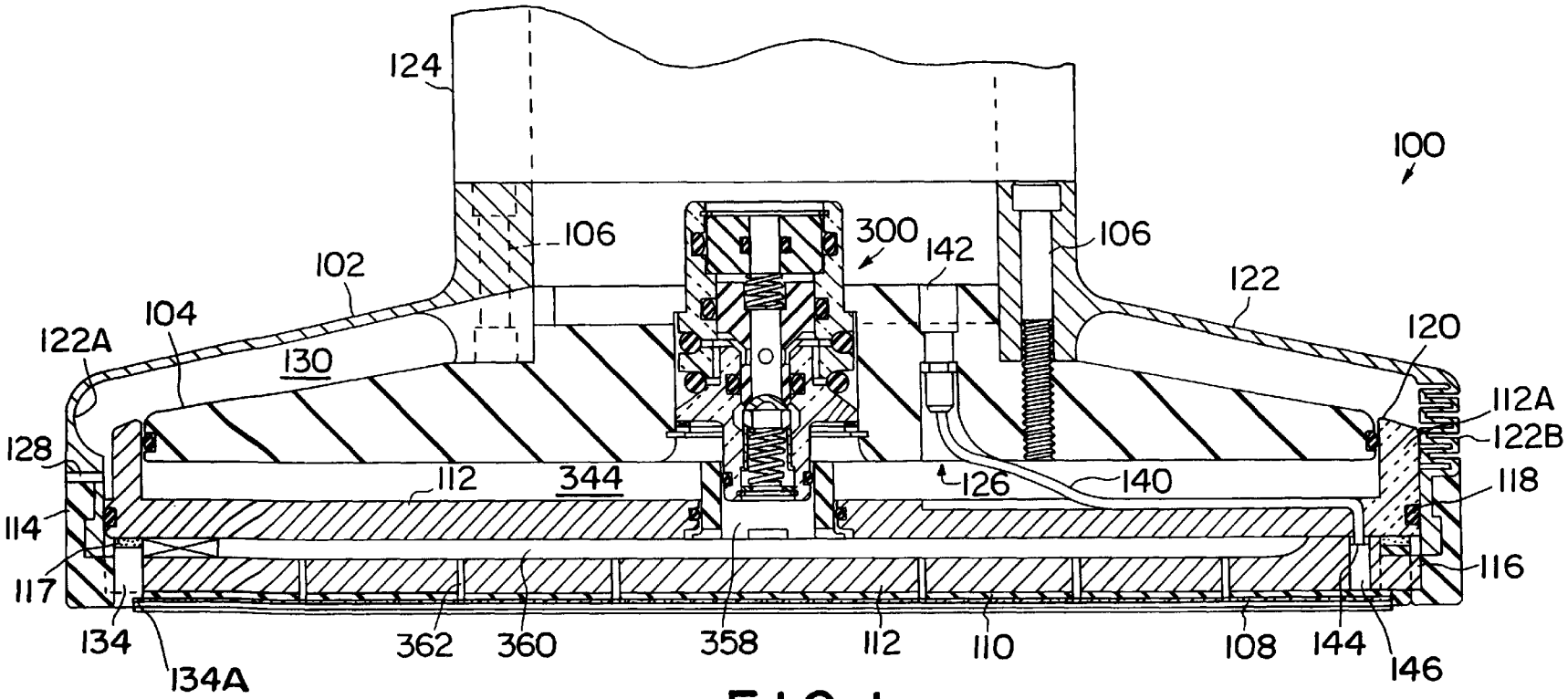
FIG. 1 is a cross-section view of an exemplary carrier assembly in accordance with the present invention.
Figure 3:
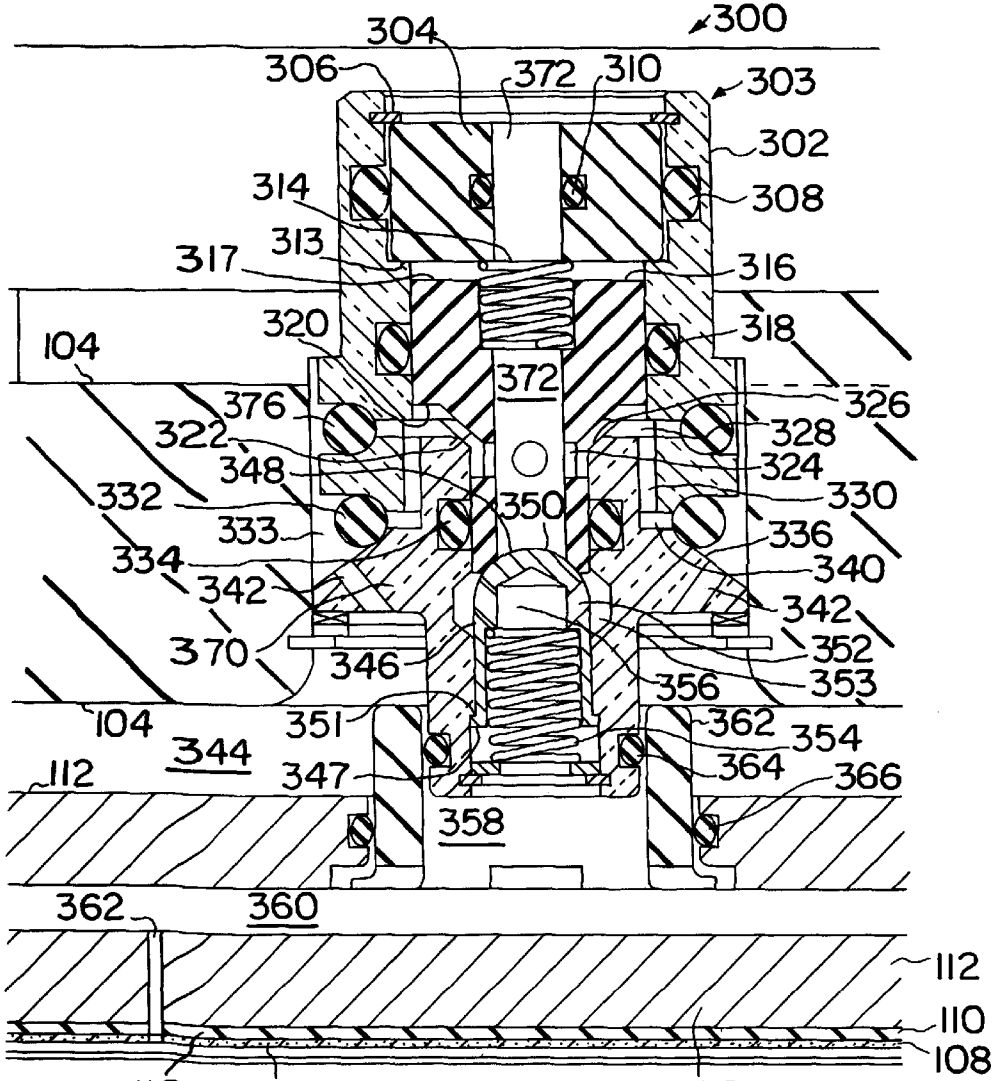
FIG. 3 is an enlarged cross-section view of the valving mechanism associated with the carrier assembly of FIG. 1.

Referring now to FIG. 1, an exemplary wafer carrier assembly 100 in accordance with the present invention suitably comprises an outer housing 102 rigidly secured to a central hub 104 through a plurality of anchor bolts 106. A valving assembly 300, discussed in greater detail in conjunction with FIG. 3, is disposed within the interior of hub 104.

Housing 102 is coupled to a carrier drive shaft 124, for example through a quick release or other removable coupling device to permit the convenient replacement of carrier assemblies 100 during use.

A pad load ring 114 is desirably secured to housing 102, for example via a bayonet lock or other convenient mechanism. In this way, the outer ring 114 may be conveniently removed and replaced as necessary, for example if the outer ring becomes deteriorated as a result of prolonged wear against the polishing pad.

A wafer pressure load plate 112 is suitably configured to engage outer ring 114 such that as outer ring 114 is rotationally driven by drive shaft 124 via housing 102, load plate 112 is concomitantly driven through a series (e.g., 5) of evenly distributed drive tangs 116. More particularly, respective drive tangs 116 extend radially from load plate 112 and engage outer ring 114 in a splined configuration; in this way, outer ring 114 suitably drives load plate 112 rotationally, yet load plate 112 is free to float axially within outer ring 114 by virtue of the splined engagement of drive tangs 116 with respect to outer ring 114.

A compliant backing pad 110, for example a rubber pad having an adhesive coating on its downward facing surface, is suitably disposed in a sandwich configuration between load plate 112 and a workpiece 108. Although workpiece 108 may comprise any one of a variety of workpieces in the context of the present invention, in a preferred embodiment workpiece 108 suitably comprises a semiconductor wafer, for example a wafer formed of single crystal silicon.

With continued referenced to FIG. 1, it can be seen that workpiece 108, backing pad 110, and load plate 112 essentially form an integral assembly which "floats" within outer pad load ring 114. More particularly, annular extension 112A of load plate 112 suitably floats axially with respect to hub 104, facilitated by a cup seal 120 disposed about the periphery of hub 104 at the interface between hub 104 and extension 112A. In addition, a wiper seal 118 permits load plate 112 to glide upwardly and downwardly within outer ring 114.

Load plate 112, backing pad 110 and workpiece 108 are suitably circumscribed within an inner wafer retaining ring 134.

Figure 2:
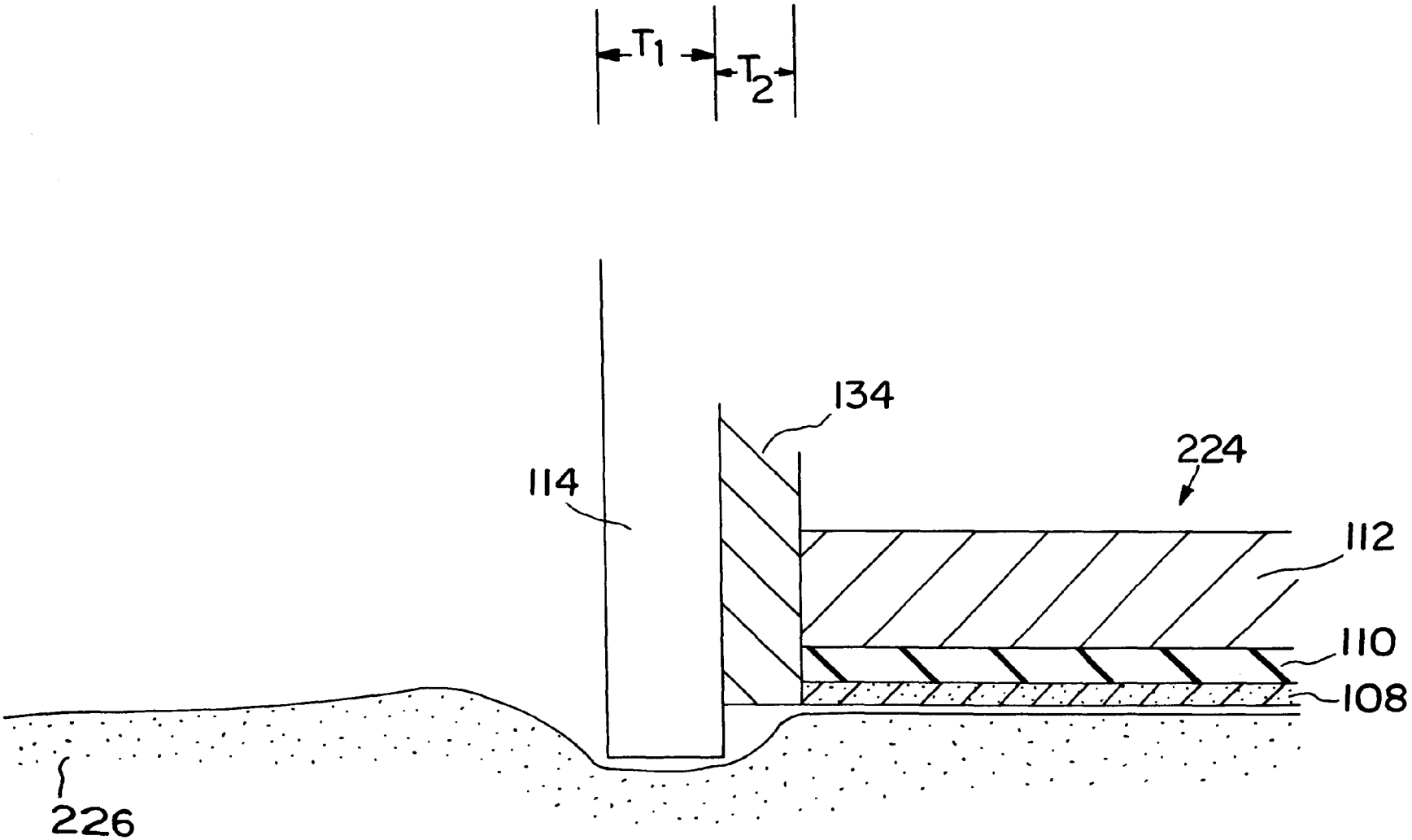
FIG. 2 is a schematic, enlarged view of a section of an alternate embodiment of the carrier assembly of FIG. 1, illustrating local deformations in the pad caused by the outer load ring.

With momentary reference to FIG. 2, inner retaining assembly 224 suitably comprises inner ring 134, load plate 112, backing pad 110, and workpiece 108. In this fashion, assembly 224 is suitably configured to float axially with respect to outer ring 114 as a function of deviations from absolute planarity exhibited by polishing pad 226. Moreover, as a result of the flexural characteristics of housing 102, outer ring 114 is suitably configured to exhibit a substantially constant downward force on pad 226 even as floating assembly 224 floats axially with respect to outer ring 114.

With continued reference to FIG. 2, it can be seen that outer ring assembly 114 exhibits a downward force on pad 226 of sufficient magnitude to effect a slight local deformation in the pad in the immediate vicinity of outer ring 114 (the degree of deformation in pad 226 is exaggerated in FIG. 2 for clarity). In accordance with a preferred embodiment of the present invention, outer ring 114 thereby advantageously conditions pad 226 in situ during the polishing operation. Moreover, in accordance with a further aspect of the present invention, the thickness ($T_1$) of outer ring 114 is suitably in the range of 6 to 24 millimeters and most preferably about 8 to 9 millimeters, whereas the thickness ($T_2$) of inner ring 134 is suitably in the range of 3 to 12 millimeters and most preferably about 5 millimeters. In this way, sufficient clearance is allowed to permit pad 226 to substantially recover from the local deformation imposed by outer ring 114, such that the pad contacts and hence polishes the entire undersurface of workpiece 108, thereby mitigating edge exclusion drawbacks associated with prior art designs.

In accordance with an alternate embodiment to the present invention, the inner retaining ring may be configured to float on the pad during the polishing process, and to retract upwardly when the workpiece is not in contact with the polishing pad, for example through the use of springs, pneumatic or hydraulic pressure, or through any other convenient mechanism for retracting the retaining ring to thereby expose the carrier and workpiece. In accordance with this alternate embodiment, the loading of a workpiece onto the carrier and the retrieval of a workpiece from the carrier may be facilitated by retracting the retaining ring out of the way during such operations.

Referring again to FIG. 1, a wiper seal 118 is suitably disposed about the outer perimeter of the upper portion of load plate 112; wiper seal 118 is suitably outwardly biased against the lower portion of the inner diameter of housing 102. In this way, inner retainer ring assembly 224 and, more particularly, load plate 112 is suitably permitted to glide axially with respect to housing 102 during the polishing process, thus effectively allowing workpiece 108 to float within inner retaining ring 114 as necessary to accommodate fluctuations in topography of the polishing pad. Similarly, a cup seal 120 is suitably disposed about the outer perimeter of hub 104; cup seal 120 is suitably biased outwardly against the inner diameter of extension 112A of load plate 112. This sliding engagement between load plate 112 and each of hub 104 and housing 102 permits substantially frictionless axial movement of retaining ring 134 and workpiece 108 with respect to load ring 114.

In accordance with a particularly preferred embodiment, housing 102 is suitably made from any resiliently deformable material, for example ultrem. As best seen in FIG. 1, an annular web segment 122 of housing 102 may be any desired thickness; in accordance with a particularly preferred embodiment, the thickness of web segment 122 is suitably on the order of 0.5 to 6 millimeters, resulting in a spring force versus axial position characteristic of load ring 114 which exhibits a dead band in the desired operating region. That is, web segment 122 is suitably configured to flex in a resiliently deformable manner, such that as the axial position of ring 114 varies during the polishing process, whether due to surface deviations in the pad or due to wear at the distal, bottom facing annulus comprising load ring 114, the load ring continues to exert an essentially downward force on the pad. Moreover, various geometrical features may be incorporated into housing 102, such as radius 122A, bellows 122B, or the like to obtain desired spring force characteristics associated with housing 102.

In the exemplary embodiment shown in FIG. 1, retaining ring 134 suitably exhibits an annular step 134A, which securely retains workpiece 108 within the retaining ring. In the alternate embodiment shown in FIG. 2, this step is eliminated, such that load plate 112 exerts downward pressure via backing pad 110 across the entire upward facing surface area of workpiece 108.

Referring again to FIG. 1, in accordance with a further aspect of the present invention a plurality of wafer loss sensor assemblies 126 are suitably disposed within the interior of housing 102.

More particularly, wafer loss sensor assembly 126 suitably comprises a sensor 144, a connector 142, and a conductor 140 interconnecting connector 142 and sensor 144. In a preferred embodiment, a plurality (e.g., 3) of sensors are suitably mounted within hub 104, with connector 140 extending through the low pressure zone 204 (discussed in greater detail in connection with FIG. 3). Each connector 140 is suitably configured to terminate in a respective recess 146 formed in load plate 112 such that sensor 144 may detect the presence and/or position of the workpiece being polished. In this regard, sensor 144 may suitably comprise any of a variety of sensor modalities, including accelerometers, position sensors, optical sensors, capacitance sensors, or the like. In a preferred embodiment, detector 144 is suitably configured to function as a capacitance sensor, wherein the wafer itself forms part of the capacitance system.

More particularly, sensor 144 may be suitably configured to detect a capacitance level in the region between detector 144 and the workpiece and to transmit a signal (e.g., a current signal or a voltage signal) representative of that capacitance to connector 142. Connector 142 is advantageously configured to transmit a signal indicative of the capacitance level at region 146 to an external display, a central computer, or the like. In this way, should the workpiece become dislodged from the underside of wafer carrier 100, the capacitance value at region 146 would change dramatically and instantaneously, resulting in a real time indication to the operator or to the CMP machine that a wafer loss condition has been detected.

Moreover, by employing two or more sensor assemblies 126 within the same carrier assembly, the capacitance level of each of the sensors should be approximately equal to one another during normal operating conditions. In the capacitive sensing paradigm employed in conjunction with a preferred embodiment of the present invention, if a wafer becomes broken, for example by cracking or even breaking off one or more pieces from the wafer, one or more of the capacitance values detected by the respective wafer loss sensors should reflect an immediate, significant change in capacitance; in accordance with one aspect of the present invention, a wafer cracked or wafer broken condition could be transmitted to the machine controller to immediately cease processing simultaneously with or even before the damaged workpiece escapes from the retaining ring. By detecting wafer loss (or wafer damage) conditions in situ as described herein, processing can be terminated before pieces of broken wafer (or an entire wafer) escape from the carrier assembly, thereby mitigating or even eliminating entirely damage to other wafers which may be being polished on the same CMP machine. For a further discussion of wafer loss detection techniques, see co-pending U.S. patent application Ser. No. 08/653,150, entitled "Method and Apparatus for the In-Process Detection of Workpieces in a CMP Environment", filed Jul. 18, 1996; U.S. patent application Ser. No. 08/781,132, entitled "Method and Apparatus for the In-Process Detection of Workpieces with a Monochromatic Light Source", filed Jan. 9, 1997; U.S. patent application Ser. No. 08/687,710, entitled "Method and Apparatus for the In-Process Measurement of Thin Film Layers", filed Jul. 26, 1996; U.S. patent application Ser. No. 08/798,803, entitled "Method and Apparatus for Detecting Removal of Thin Film Layers During Planarization", filed Feb. 12, 1997; U.S. patent application Ser. No. Yet to Be Assigned, entitled "Method and Apparatus for Cleaning Workpiece Surfaces and Monitoring Probes During Workpiece Processing", filed Jul. 16, 1997; U.S. patent application Ser. No. Yet to Be Assigned, entitled "Method and Apparatus for the In-Process Detection of Workpieces with a Physical Contact Probe", filed Jul. 10, 1997. The entire contents of the aforementioned patent applications are hereby incorporated herein.

With continued reference to FIG. 1, depending upon the particular sensing methodology employed, it may be desirable to remove a small portion of backing pad 110 in the vicinity of each of the respective recesses 146 to permit, as desired, direct electrical, optical, or other contact between sensor 144 and workpiece 108.

Figure 4:
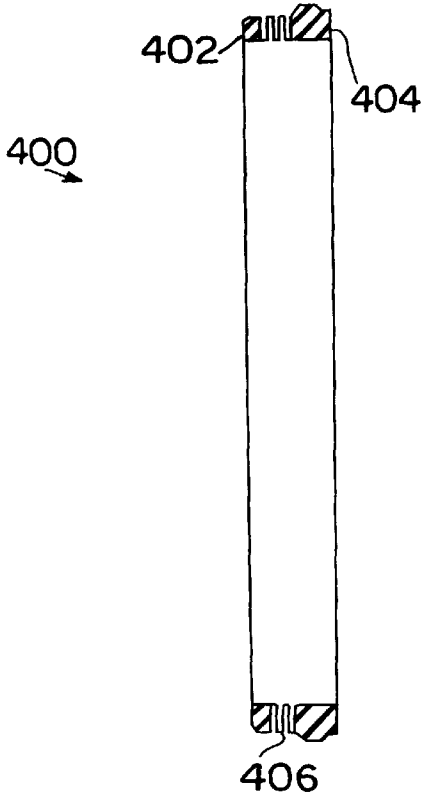
FIG. 4 is a cross-section view of an alternate embodiment of an inner retaining ring assembly in accordance with the present invention.

Referring now to FIG. 4, in accordance with an alternate embodiment of the present invention, inner retaining ring 134 may suitably be replaced with an alternate retaining ring 400. In particular, retaining ring 400 suitably comprises an annular ring having a downward facing distal portion 402 and an upper portion 404, with a flexible region 406 disposed there between. In the illustrated embodiment, flexible region 406 suitably comprises bellows; it would be appreciated, however, that the flexible region may comprise any suitable construction which permits distal portion 402 to expand and contract axially with respect to upper portion 404. With continued reference to FIGS. 1 and 4, it can be seen that the use of ring 400 in lieu of retaining ring 134 permits the retaining assembly (which may include the workpiece and carrier 112) to float on the polishing surface, aided by the resiliently deformable bellows 406. In this way, the use of an optional flexible annular pad 117 (see FIG. 1) may be eliminated. In accordance with a further aspect of alternate ring 400, upper portion 404 thereof may suitably may be configured to engage carrier 112 such that distal portion 402 is permitted to float on the polishing surface with respect to the workpiece.

Referring now to FIG. 3, a preferred exemplary embodiment of valving assembly 300 will now be described in the context of the present invention.

It will be appreciated that valving assembly 300 advantageously facilitates three general operational modes of carrier 100: 1) transfer mode, during which a vacuum is drawn at the undersurface of load plate 112 so that the workpiece adheres to the undersurface of the load plate during loading and transfer of the workpieces, for example from a load station to the polishing table prior to polishing or from the polishing table to an unload station after polishing has been completed; 2) a polishing mode, wherein low pressure is applied to the upward facing surface of load plate 112 to thereby firmly urge workpiece 108 against the surface of the polishing table during the polishing operation; and 3) discharge mode, wherein high pressure is applied to the upper surface of workpiece 108 to thereby liberate the workpiece from the carrier after the wafer has completed the polishing process and the wafer has been transferred to an unload station.

Valving assembly 300 is suitably configured to accommodate the foregoing three operational modes. In accordance with a preferred embodiment of the present invention, valving assembly 300 is suitably configured to apply low pressure to the workpiece during the polishing process, high pressure to the workpiece during the discharge operation, and vacuum to the workpiece during the transfer mode of operation. In accordance with a particularly preferred embodiment of the present invention, valving assembly 300 is advantageously configured to selectively apply low pressure, high pressure and vacuum through a single supply orifice 372 which extends down the interior of drive shaft 124.

More particularly, valve assembly 300 suitably comprises a valve housing 303, a tube adapter 304, a pressure/vacuum sensitive spool 316, a floating relief valve 346, and respective biasing springs 314 and 354. In the illustrated embodiment, valve housing 303 suitably comprises an upper housing portion 302 and a lower housing portion 370 which function is a single, rigid body in the preferred embodiment.

Air tube adapter 304 is secured within valve housing 303 by a spring clip 306 which suitably exhibits a thickness calculated to urge the bottom of adapter 304 against an annular shoulder 313 inside of housing 303. O-ring 308 is advantageously configured to absorb any lateral tolerances between the outer diameter of adapter 304 and the corresponding inner diameter of housing 303 in the vicinity of adapter 304.

The inner diameter of adapter 304 suitably defines a tube receiving conduit 372 within which a feed tube (not shown) is inserted. More particularly, when carrier assembly 100 is mounted to drive shaft 124 (FIG. 1), an air supply feed tube is suitably extended through the interior axial portion of drive shaft 124, such that it terminates within supply conduit 372 to thereby supply low pressure air, high pressure air, and vacuum to the interior of valve assembly 300 to facilitate the aforementioned three operational modes of the CMP machine with which carrier assembly 100 is associated. An o-ring 310 is suitably disposed within the interior of adapter 304 to adaptively receive the feed tube in a tight fitting yet low friction connection.

With continued reference to FIG. 3, during the polishing mode of operation of the CMP machine, low pressure air is supplied to a low pressure region 344, which region substantially comprises the area between the bottom surface of hub 104 and the upper surface of load plate 112 (see also, FIG. 1). In this way, workpiece 108 is urged downwardly against the polishing pad during the polishing operation. In a preferred embodiment, the low pressure air supplied to the top surface of load plate 112 is suitably in the range of 5 p.s.i. which results in a downward force on the workpiece in the range of approximately 350 pounds.

During the polishing mode of operation, low pressure air is supplied to the interior region of spool 316. This low pressure air is thus applied to port 324, which freely communicates with respective path segments 328, 324 and 340. When initially applied, the low pressure air may force o-ring 376 to expand slightly; however, o-ring 332 is suitably configured to expand at a lower pressure than o-ring 376; consequently, the application of low pressure air inside of spool 316 causes o-ring 332 to expand, which may allow o-ring 332 to be drawn downwardly along ramp 336. In any event, low pressure air will be applied to region 333, which region communicates with low pressure zone 344 via path segment 342. Low pressure zone 344 thereafter remains at the desired pressure for so long as the low pressure air from the feed tube is supplied to region 372.

During the low pressure (polishing) mode of operation, the spring force exerted by biasing spring 354 urges relief valve 346 upwardly, so that the annular foot 347 of relief valve 346 is urged upwardly against an annular shoulder 351 of housing segment 336. At the same time, biasing spring 314 urges spool 316 downwardly, such that an angled or curved land 350 disposed at the bottom of spool 316 engages the rounded (e.g., spherical) top surface 348 of check valve 346 to thereby maintain an air-tight seal. Thus, the low pressure air within region 372 cannot escape through the air seal at land 350 into internal region 356 inside of check valve 346.

Upon completion of the polishing operation, it is desired to remove the low pressure air from the backside of load plate 112, and to apply a vacuum to respective vacuum orifices 362 to thereby draw the workpiece upwardly against load plate 112 during transportation of the workpiece from polishing table to the unload station (or during transportation of the workpiece from a load station to the polishing table, for example).

In accordance with a preferred embodiment of the present invention, low pressure air supply to region 372 may be terminated and a vacuum supplied to region 372 while leaving the air supply feed tube in its static position within adapter 304. That is, valving (not shown) associated with the feed tube within the CMP machine may simply be actuated to change the air supply in the feed tube from low pressure (load pressure) to vacuum.

With continued reference to FIG. 3, when a vacuum is applied to region 372, respective o-rings 376 and 322 are drawn into the positions shown in FIG. 3. Because the surface area of spool 316 having a vector component in the upward axial direction is greater than the surface area of spool 316 having a vector component in the downward axial direction, drawing a vacuum inside of housing 303 has the effect of urging spool 316 upwardly against the biasing force of spring 314 as shown in FIG. 3. As spool 316 is drawn upwardly, the air seal at land 350 is broken, porting a vacuum into the region 353 which surrounds check valve 348. Vacuum is further ported through path segment 352 and into an internal region 356 within the check valve, which freely communicates with region 358 below the check valve and finally to low pressure region 360. Vacuum is ported to respective vacuum conduits 362, to thereby draw the workpiece up against the underside of the load plate.

In accordance with a particularly preferred embodiment, during a stabilized vacuum condition, spool 316 may be biased back downwardly by spring 314, thereby re-establishing an air seal at land 350. In accordance with this aspect of the present invention, for so long as a vacuum seal is maintained at land 350, the vacuum supplied to region 372 may be terminated while preserving the vacuum which draws the workpiece to the load plate.

When it is desired to liberate the workpiece from carrier 100, valving assembly 300 enters the high pressure (discharge) mode of operation.

More particularly, when it is desired to remove a workpiece from the carrier, high pressure air or, alternatively, a mixture of high pressure air and water or other gas/fluid combination is supplied by the feed tube to region 372. In the context of the present invention, the high pressure air/gas combination is suitably applied at in the range of 30 to 40 p.s.i. Upon the application of high pressure to region 372, the high pressure air acts against upper surface 317 of spool 316, urging spool 316 downwardly. At the same time, the high pressure air pushes crown 350 of check valve 346 downwardly, such that the spool and check valve are urged downwardly together, aided by spring 314 against the force of spring 354. Spool 316 and check valve 346 move downwardly while at the same time o-rings 376 and 332 may be blown radially outwardly. Spool 316 travels downwardly until angled land 322 of spool 316 contacts corresponding angled land 326 of upper housing portion 302. In a particularly preferred embodiment, respective lands 322 and 326 are suitably conical, thereby creating a 45 degree annular seat between the spool and the housing. When spool 316 is seated against land 326, any high pressure which may have been supplied to path segments 328, 330 and 336 is terminated, so that o-rings 376 and 322 retract, allowing the air to be vented to atmosphere via bleed hole 128 (see FIG. 1). When spool 316 is in its downward most position, however, the high pressure supply air continues to urge check valve 346 downwardly, against the biasing of spring 354. With spool 316 seated against housing portion 336 and with check valve 346 urged further downwardly, check valve 346 separates from spool 316, allowing high pressure air to be ported through path segment 352 to interior region 356. High pressure air is thus supplied to low pressure region 360 and thereafter to respective vacuum conduits 362. By supplying high pressure air to vacuum conduits 362, the workpiece is forcibly discharged from the carrier.

With continued reference to FIGS. 1–3, it should be noted that to the extent backing pad 110 constitutes a thin, planar sheet of rubber or other material for maintaining a high frictional engagement with the workpiece, backing pad 110 is suitably configured with holes to permit high pressure and vacuum communication through vacuum conduits 362 to the workpiece.

It will be appreciated that the foregoing description is a preferred exemplary embodiment of the present invention, and that the invention is not limited to the specific configurations described herein. Indeed, various modifications, substitutions, and the like may be made to the design, arrangement, and function of the parts discussed herein without departing from the spirit and scope of the present invention as set forth in the appended claims.

I claim:

1. A workpiece carrier assembly, comprising:

a resiliently deformable, flexible outer housing having an inner hub rigidly secured thereto, said outer housing being releasably coupled to a rotatable shaft;

a carrier having a lower surface configured to conform to an upper surface of a workpiece, and an upper surface upon which pressure is applied to urge said workpiece into sliding engagement with a polishing surface;

an inner retaining ring configured to retain said workpiece within said carrier assembly during said sliding engagement with said polishing surface;

an outer retaining ring, rigidly secured to said deformable housing, configured to depress said polishing surface in the vicinity of said outer retaining ring;

wherein said inner retaining ring, said carrier, and said workpiece are configured to float as an integral unit with respect to said outer retaining ring.

2. A carrier assembly as claimed in claim 1, wherein said outer housing is made from ultrem.

3. A carrier assembly as claimed in claim 1, wherein said outer retaining ring is secured to web segments of said housing that are configured to flex in a resiliently deformable manner.

4. A carrier assembly as claimed in claim 3, wherein said web segments have a thickness in a range of 0.5 to 0.6 millimeters.

5. A carrier as claimed in claim 1, wherein said outer retaining ring is detachable from said housing.

6. A carrier assembly as claimed in claim 1, wherein said carrier comprises a load plate and a compliant backing pad attached to a lower surface of said load plate.

7. A carrier assembly as claimed in claim 6, wherein drive tangs extend radially from said load plate and engage said outer retaining ring in a splined configuration, such that said load plate moves with said outer retaining ring rotationally and moves relative to said outer retaining ring vertically.

8. A carrier assembly as claimed in claim 1, wherein said outer retaining ring has a thickness T1 and said inner retaining ring has a thickness T2 to provide sufficient clearance for said polishing surface to recover from deformation effected by said outer retaining ring such that said polishing surface contacts the entire bottom surface of said workpiece.

9. A carrier assembly as claimed in claim 8, wherein said thickness T1 is in a range of approximately 8 to 9 millimeters, and said thickness T2 is approximately 5 millimeters.

10. A carrier assembly as claimed in claim 6, and further comprising at least one workpiece loss sensor assembly.

11. A carrier assembly as claimed in claim 10, wherein said sensor assembly comprises a sensor mounted within a recess formed in said load plate to detect the presence and position of said workpiece.

12. A carrier assembly as claimed in claim 11, wherein said sensor is configured to detect a capacitance level between said sensor and said workpiece and to transmit a signal indicative of said capacitance level.

13. A carrier assembly as claimed in claim 1, wherein said inner retaining ring comprises a distal portion, an upper portion, and a flexible region connecting said distal portion and said upper portion to permit said inner retaining ring, said carrier and said workpiece to float on said polishing surface.

14. A carrier assembly as claimed in claim 13, wherein said flexible region comprises bellows.

15. A carrier assembly as claimed in claim 1, and further comprising a valving assembly configured to apply low pressure to said carrier upper surface while said workpiece is being polished, high pressure to said carrier lower surface to discharge said workpiece; and a vacuum to said carrier lower surface to retain said workpiece on said carrier.

16. A carrier assembly as claimed in claim 15, and further comprising:

a low pressure chamber in fluid communication with said upper surface of said carrier;

a vacuum/high pressure chamber in fluid communication with said lower surface of said carrier; and wherein said valving assembly comprises a valve housing surrounding an interior valve chamber;

pressure means for supplying low pressure, high pressure and vacuum pressure to said valve chamber;

first check valve means for establishing communication between said valve chamber and said low pressure chamber upon supply of low pressure to said valve chamber; and second check valve means for establishing communication between said valve chamber and said vacuum/high pressure chamber upon supply of high pressure or vacuum pressure to said valve chamber.

17. A carrier assembly as claimed in claim 16, wherein said pressure means comprises a tube receptacle disposed within a top portion of said valve chamber, and a pressure supply tube received in said tube receptacle.

18. A carrier assembly as claimed in claim 16, wherein said first check valve means comprises at least one o-ring disposed at an external terminus of a path formed through said valve housing, said o-ring expanding away from said path upon introduction of low pressure into said valve chamber to allow said low pressure to port through said path and into said low pressure chamber to push said carrier toward said polishing surface, and said o-ring receding into and blocking said path to prevent porting of vacuum pressure or high pressure through said path and into said low pressure chamber.

19. A carrier assembly as claimed in claim 16, wherein said second check valve means comprises:

a vertically movable pressure spool disposed in an upper portion of said valve chamber, a curved land being formed on a bottom portion of said spool, and a conical stop being formed on an outer radial portion of said spool, said conical stop engaging a mating conical stop formed on an inside portion of said housing to limit downward movement of said spool;

a vertically movable relief valve disposed in a lower portion of said valve chamber, a rounded top surface being formed on said relief valve, and an annular foot being formed on an outer radial portion of said relief valve, said foot engaging a mating annular shoulder formed on said inside portion of said housing to limit upward movement of said relief valve;

first spring means disposed above said spool for urging said spool downwardly such that said curved land of said spool contacts and forms a seal with said rounded top surface of said relief valve to close communication between said valve chamber and said vacuum/high pressure chamber, wherein said spool and said relief valve move upwardly against said first spring means upon application of a vacuum to said valve chamber, said foot on said relief valve eventually engaging said shoulder in said housing to stop upward movement of said relief valve while said spool continues to move upward to break said seal and to allow said vacuum to be ported through said relief valve and into said vacuum/high pressure chamber to draw said workpiece against said carrier; and second spring means disposed below said relief valve for urging said relief valve upwardly and into contact with said spool to form said seal, and wherein said relief valve and said spool move downwardly upon application of high pressure to said valve chamber, said conical stop on said spool eventually engaging said conical stop in said valve housing to stop downward movement of said spool while said relief valve continues to move downward to break said seal and to allow said high pressure to be ported through said relief valve and into said vacuum/high pressure chamber to discharge said workpiece from said carrier.

20. A carrier assembly for a workpiece comprising:

an outer housing;

a load plate assembly for carrying said workpiece and pressing said workpiece against said polishing surface;

and a valving assembly configured to apply low pressure to an upper surface of said load plate assembly to press said load plate assembly downward and said workpiece into contact with said polishing surface, high pressure to a lower surface of said load plate assembly to discharge said workpiece, and vacuum pressure to said lower surface to retain said workpiece.

21. A carrier assembly as claimed in claim 20, and further comprising:

a low pressure chamber in fluid communication with said upper surface of said load plate assembly;

a vacuum/high pressure chamber in fluid communication with said lower surface of said load plate assembly; and wherein said valving assembly comprises a valve housing surrounding an interior valve chamber;

pressure means for supplying low pressure, high pressure and vacuum pressure to said valve chamber;

first check valve means for establishing communication between said valve chamber and said low pressure chamber upon supply of low pressure to said valve chamber; and second check valve means for establishing communication between said valve chamber and said vacuum/high pressure chamber upon supply of high pressure or vacuum pressure to said valve chamber.

22. A carrier assembly as claimed in claim 21, wherein said first check valve means comprises at least one o-ring disposed at an external terminus of a path formed through said valve housing, said o-ring expanding away from said path upon introduction of low pressure into said valve chamber to allow said low pressure to port through said path and into said low pressure chamber to push said load plate assembly toward said polishing surface, and said o-ring receding into and blocking said path to prevent porting of vacuum pressure or high pressure through said path and into said low pressure chamber.

23. A carrier assembly as claimed in claim 22, wherein said second check valve means comprises:

a vertically movable pressure spool disposed in an upper portion of said valve chamber, a curved land being formed on a bottom portion of said spool, and a conical stop being formed on an outer radial portion of said spool, said conical stop engaging a mating conical stop formed on an inside portion of said housing to limit downward movement of said spool;

a vertically movable relief valve disposed in a lower portion of said valve chamber, a rounded top surface being formed on said relief valve, and an annular foot being formed on an outer radial portion of said relief valve, said foot engaging a mating annular shoulder formed on said inside portion of said valve housing to limit upward movement of said relief valve;

first spring means disposed above said spool for urging said spool downwardly such that said curved land of said spool contacts and forms a seal with said rounded top surface of said relief valve to close communication between said valve chamber and said vacuum/high pressure chamber, wherein said spool and said relief valve move upwardly against said first spring means upon application of a vacuum to said valve chamber, said foot on said relief valve eventually engaging said shoulder in said housing to stop upward movement of said relief valve while said spool continues to move upward to break said seal and to allow said vacuum to be ported through said relief valve and into said vacuum/high pressure chamber to draw said workpiece against said load plate assembly; and second spring means disposed below said relief valve for urging said relief valve upwardly and into contact with said spool to form said seal, and wherein said relief valve and said spool move downwardly upon application of high pressure to said valve chamber, said conical stop on said spool eventually engaging said conical stop in said valve housing to stop downward movement of said spool while said relief valve continues to move downward to break said seal and to allow said high pressure to be ported through said relief valve and into said vacuum/high pressure chamber to discharge said workpiece from said load plate assembly.

* * * * *